US006033290A

United States Patent [19]

Gurusamy et al.

[11] Patent Number: 6,033,290

[45] Date of Patent: Mar. 7, 2000

[54] CHEMICAL MECHANICAL POLISHING CONDITIONER

[75] Inventors: Jayakumar Gurusamy, Mountain View; Lawrence M. Rosenberg, San Jose; Alexander Medvinsky, Foster City, all of Calif.

[73] Assignee: Applied Materials, Inc., Santa Clara, Calif.

[21] Appl. No.: 09/162,916

[22] Filed: Sep. 29, 1998

[51] Int. Cl.[7] ..... B24B 53/03

[52] U.S. Cl. ..... 451/56; 451/41; 451/443; 451/444

[58] Field of Search ..... 451/41, 56, 285–289, 451/443, 444

[56] References Cited

U.S. PATENT DOCUMENTS

| | | | |
|---|---|---|---|
| 4,666,658 | 5/1987 | Carcey | 451/288 |
| 5,081,051 | 1/1992 | Mattingly et al. . | |
| 5,216,843 | 6/1993 | Breivogel et al. . | |
| 5,456,627 | 10/1995 | Jackson et al. . | |
| 5,486,131 | 1/1996 | Cesna et al. . | |
| 5,531,635 | 7/1996 | Mogi et al. . | |
| 5,626,509 | 5/1997 | Hayashi . | |
| 5,738,574 | 4/1998 | Tolles et al. . | |
| 5,839,947 | 11/1998 | Kimura et al. . | |
| 5,931,725 | 8/1999 | Inaba et al. | 451/288 |

FOREIGN PATENT DOCUMENTS

WO 99/02305 1/1999 WIPO .

*Primary Examiner*—Robert A. Rose
*Assistant Examiner*—George Nguyen
*Attorney, Agent, or Firm*—Fish & Richardson

[57] ABSTRACT

A conditioner head uses a fluid purge system to prevent debris from entering openings in the conditioner head and causing deterioration of bearings and other moving components in the conditioner head. The fluid may be a gas, such as nitrogen, or a liquid, such as water or reactive solvents.

16 Claims, 4 Drawing Sheets

10
50
48
42
18
46
44
20
57
14
62
56
74
64
60
66
14
76
52
54
14
16
12

CHEMICAL MECHANICAL POLISHING CONDITIONER

BACKGROUND

This invention relates generally to the planarization of semiconductor substrates and, more particularly, to a chemical mechanical polishing conditioner.

Integrated circuits are typically formed on substrates, particularly silicon wafers, by the sequential deposition of conductive, semiconductive or insulative layers. Specific structures and devices are formed by preferential etching of the layers aided by photolithography. High resolution and accurate focusing of the photolithography apparatus allows the formation of well defined micro- or nano-structures. Accurate focusing of the photolithography apparatus is difficult for non-planar surfaces. Therefore, there is a need to periodically planarize the substrate surface to provide a planar surface. Planarization, in effect, polishes away a non-planar, outer surface, whether a conductive, semiconductive, or insulative layer, to form a relatively flat, smooth surface.

Chemical mechanical polishing is one accepted method of planarization. This planarization method typically requires that the substrate be mounted on a carrier or polishing head, with the surface of the substrate to be polished exposed. The substrate is then placed against a rotating polishing pad. The carrier head provides a controllable load, i.e., pressure, on the substrate to push it against the polishing pad. In addition, the carrier head may rotate to provide additional motion between the substrate and polishing surface. Further, a polishing slurry, including an abrasive and at least one chemically-reactive agent, may be spread on the polishing pad to provide an abrasive chemical solution at the interface between the pad and substrate.

The effectiveness of a CMP process may be measured by its polishing rate, and by the resulting finish (absence of small-scale roughness) and flatness (absence of large-scale topography) of the substrate surface. Inadequate flatness and finish can produce substrate defects. The polishing rate, finish and flatness are determined by the pad and slurry combination, the relative speed between the substrate and pad, and the force pressing the substrate against the pad. The polishing rate sets the time needed to polish a layer. Thus, it sets the maximum throughput of the polishing apparatus.

It is important to take appropriate steps to counteract any deteriorative factors which may either damage the substrate (such as by scratches resulting from accumulated debris in the pad) or reduce polishing speed and efficiency (such as results from glazing of the pad surface after extensive use). The problems associated with scratching the substrate surface are self-evident. The more general pad deterioration problems both decrease polishing efficiency, which increases cost, and create difficulties in maintaining consistent operation from substrate to substrate as the pad decays.

The glazing phenomenon is a complex combination of contamination, thermal, chemical and mechanical damage to the pad material. When the polisher is in operation, the pad is subject to compression, shear and friction producing heat and wear. Slurry and abraded material from the wafer and pad are pressed into the pores of the pad material and the material itself becomes matted and even partially fused. These effects reduce the pad's roughness and its ability to efficiently polish the substrate.

It is, therefore, desirable to continually condition the pad by removing trapped slurry, and unmatting or re-expanding the pad material.

A number of conditioning procedures and apparatus have been developed. A conventional conditioner has an arm holding a conditioner head with an abrasive disk against the polishing pad. A bearing system rotatably supports the abrasive disk at the end of the arm. The abrasive disk rotates against the polishing pad to physically abrade the polishing pad and remove the glazing layer from the polishing pad.

During the conditioning operation, slurry or fragments of the polishing pad glazing layer may enter openings in the conditioner head and interfere with its rotational motion. In particular, if slurry is deposited on the bearing system, it may cause bearing reliability problems and may reduce the life of the conditioning head.

SUMMARY

In general, in one aspect, the present invention features a conditioner head for conditioning the polishing surface of a polishing pad. The conditioner head has an abrasive element engageable with the polishing pad, and a drive assembly coupled to the abrasive element and transmitting rotation to the abrasive head. A housing surrounds the drive assembly and a bearing couples the drive assembly to the housing. The bearing enables rotation of the drive assembly within the housing. A fluid purge system is provided to direct fluid into the housing past the bearing to prevent particles from reaching the bearing.

Implementations of the invention may include one or more of the following features. The conditioner head may include a backing element carrying the abrasive element, and the abrasive element may be an abrasive disk. The drive assembly may have a drive element carried for rotation about a longitudinal axis and a rotatable element coupling the abrasive element to the drive element. The drive element may include a drive shaft and a collar, the collar being substantially fixed to the drive shaft. The rotatable element may include a drive sleeve surrounding at least a length of the drive shaft. The bearing may couple the collar to the housing for permitting the collar to rotate within the housing.

The housing may have a bottom opening and may include a shield attached to the bottom opening to prevent particles from entering the conditioner head and a labyrinth opening may be formed between the shield and the collar. Fluid may be supplied to the labyrinth opening.

The fluid purge system may include a source providing a fluid, and a fluid line that carries fluid from the source to the housing past the bearing and into the labyrinth opening. The fluid may be a gas selected from the group consisting of nitrogen, argon, helium and air. The fluid may also be a liquid selected from the group consisting of water and reactive solvents.

The housing may be coupled to a conditioner arm for moving the head at least transverse to the longitudinal axis and the fluid may be directed to the bearing and labyrinth opening through a fluid line in the conditioner arm and the housing.

In general, in another aspect, the invention features a conditioner head for conditioning the polishing surface of a polishing pad. The conditioner head has an abrasive element engageable with the polishing surface of the polishing pad, a drive assembly coupled to the abrasive element and transmitting rotation to the abrasive element, and a housing surrounding the drive assembly. A fluid purge system directs fluid into the housing to prevent particles from contaminating the drive assembly.

In general, in another aspect, the invention features a method for conditioning a polishing pad having a polishing surface. The method includes: providing an abrasive conditioning element carried by a carrier head and having a lower surface engageable with the polishing surface of the polishing pad, rotating the conditioning element and bringing the lower surface of the conditioning element into engagement with the polishing surface of the polishing pad, and directing a fluid past a bearing system in the carrier head, said bearing system enabling the rotation motion of the conditioning element, and said fluid preventing particles from reaching the bearing system.

Among the advantages of the invention may be one or more of the following. The flow of fluid in the labyrinth past the bearing prevents the accumulation of debris in the labyrinth. It also prevents deterioration of the bearing and other moving components in the conditioner head. This improves the reliability of the conditioner head.

Other features and advantages of the invention will be apparent from the following description of the preferred embodiments, and from the claims.

DETAILED DESCRIPTION

Figure 1:
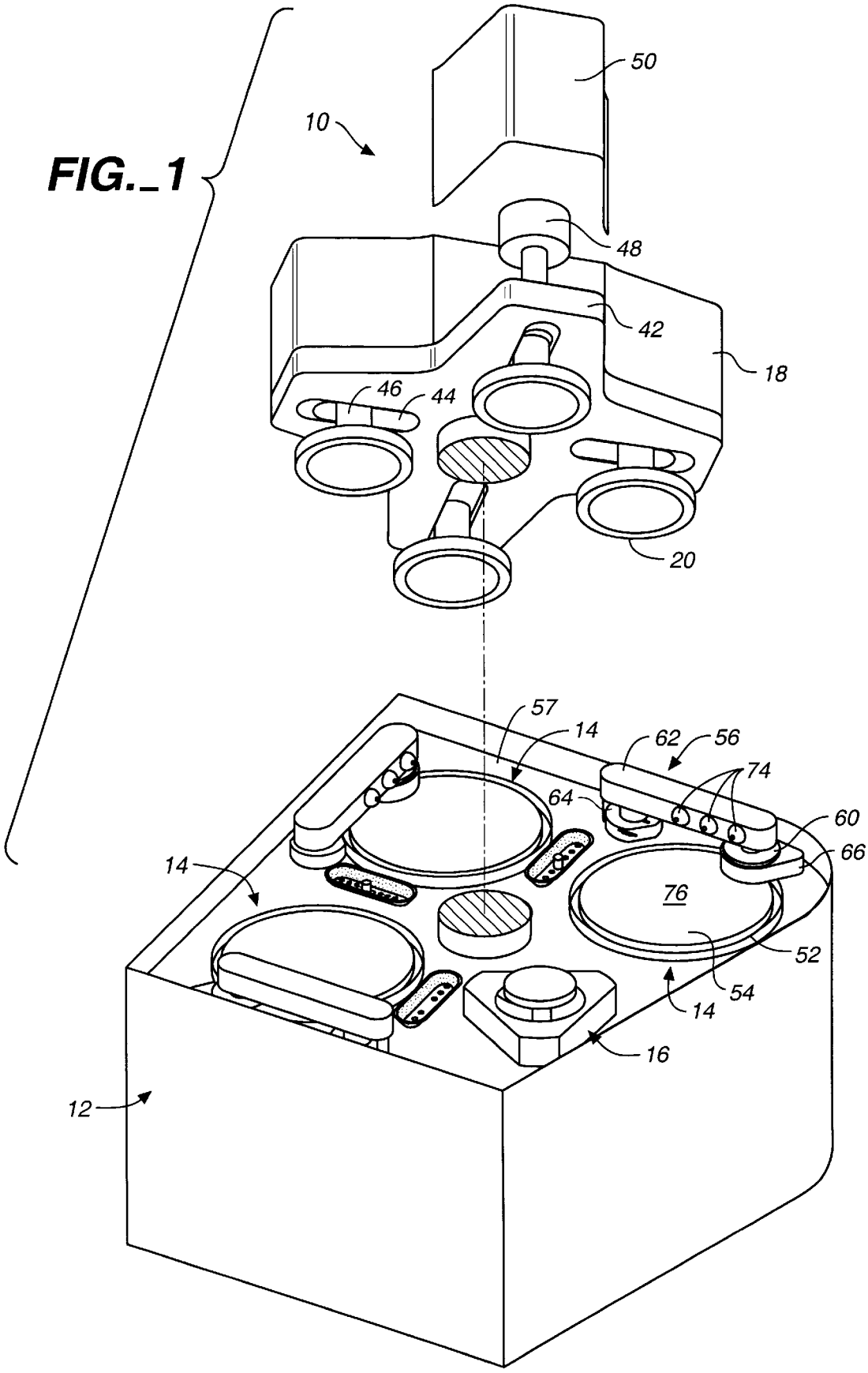
FIG. 1 is a perspective view of a chemical mechanical polishing apparatus.

Referring to FIG. 1, a chemical mechanical polishing apparatus 10 includes a housing 12 that contains three independently-operated polishing stations 14, a substrate transfer station 16, and a rotatable carousel 18 which choreographs the operation of four independently rotatable carrier heads 20. A more complete description of the polishing apparatus 10 may be found in U.S. Pat. No. 5,738,574, the entire disclosure of which is incorporated herein by reference.

The carousel 18 has a support plate 42 with slots 44 through which drive shafts 46 extend to support the carrier heads 20. The carrier heads 20 can independently rotate and oscillate back-and-forth in the slots 44 to achieve a uniformly polished substrate surface. The carrier heads 20 are rotated by respective motors 48, which are normally hidden behind a removable cover 50 (one quarter of which is removed in FIG. 1) of the carousel 18. In operation, a substrate is loaded to the transfer station 16, from which the substrate is transferred to a carrier head 20. The carousel 18 then transfers the substrate through a series of one or more polishing stations 14 and finally returns the polished substrate to the transfer station 16.

Each polishing station 14 includes a rotatable platen 52 which supports a polishing pad 54. Each polishing station 14 also includes a pad conditioner 56. A more complete description of a pad conditioner may be found in U.S. patent application Ser. No. 09/052,798, filed Mar. 31, 1998, entitled Chemical Mechanical Polishing Conditioner by Gurusamy et al., the entire disclosure of which is incorporated herein by reference.

The platen 52 and conditioner 56 are both mounted to a table top 57 inside the polishing apparatus 10. Each pad conditioner 56 includes a conditioner head 60, an arm 62, and a base 64. The arm 62 has a distal end coupled to the conditioner head 60 and a proximal end coupled to the base 64, which sweeps the conditioner head 60 across the polishing pad surface 76 to condition the surface 76 by abrading the surface to remove contaminants and retexturize the surface. Each polishing station 14 also includes a cup 66, which contains a cleaning liquid for rinsing or cleaning the conditioner head 60.

Figure 2A:
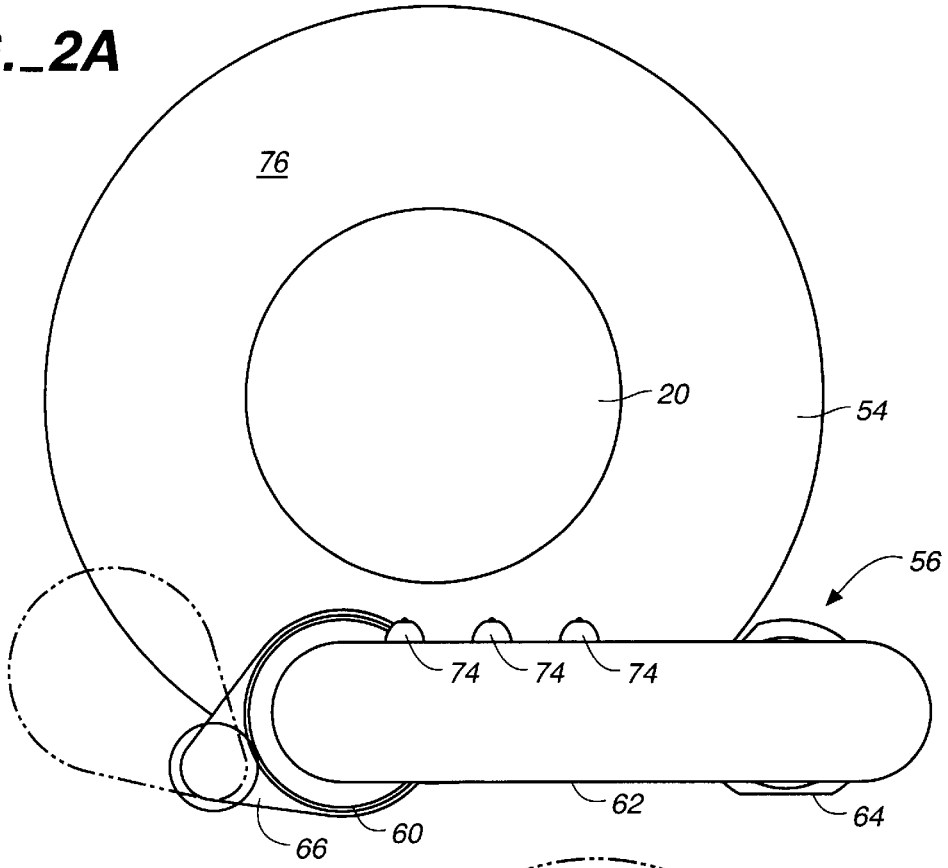
FIGS. 2A and 2B are diagrammatic top views of a substrate being polished and a polishing pad being conditioned by the polishing apparatus of FIG. 1.
Figure 2B:
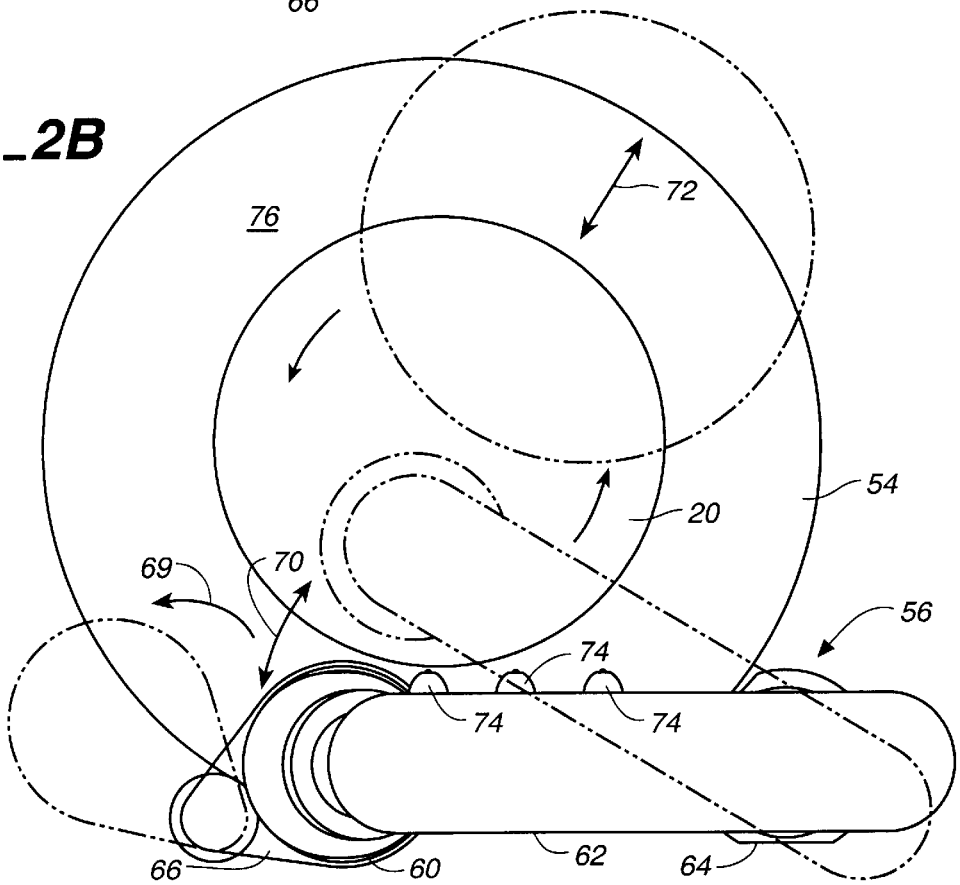

Referring to FIGS. 2A and 2B, in one mode of operation, the polishing pad 54 is conditioned by the pad conditioner 56 while the polishing pad polishes a substrate which is mounted on the carrier head 20. The conditioner head 60 sweeps across the polishing pad 54 with a reciprocal motion that is synchronized with the motion of the carrier head 20 across the polishing pad 54. For example, a carrier head 20 with a substrate to be polished may be positioned in the center of the polishing pad 54 and conditioner head 60 may be immersed in the cleaning liquid contained within the cup 66. During polishing, the cup 66 may pivot out of the way as shown by arrow 69, and the conditioner head 60 and the carrier head 20 carrying a substrate may be swept back-and-forth across the polishing pad 54 as shown by arrows 70 and 72, respectively. Optionally, three water jets 74 may direct streams of water toward the polishing pad 54 to rinse slurry from the polishing pad surface 76.

Figure 3:
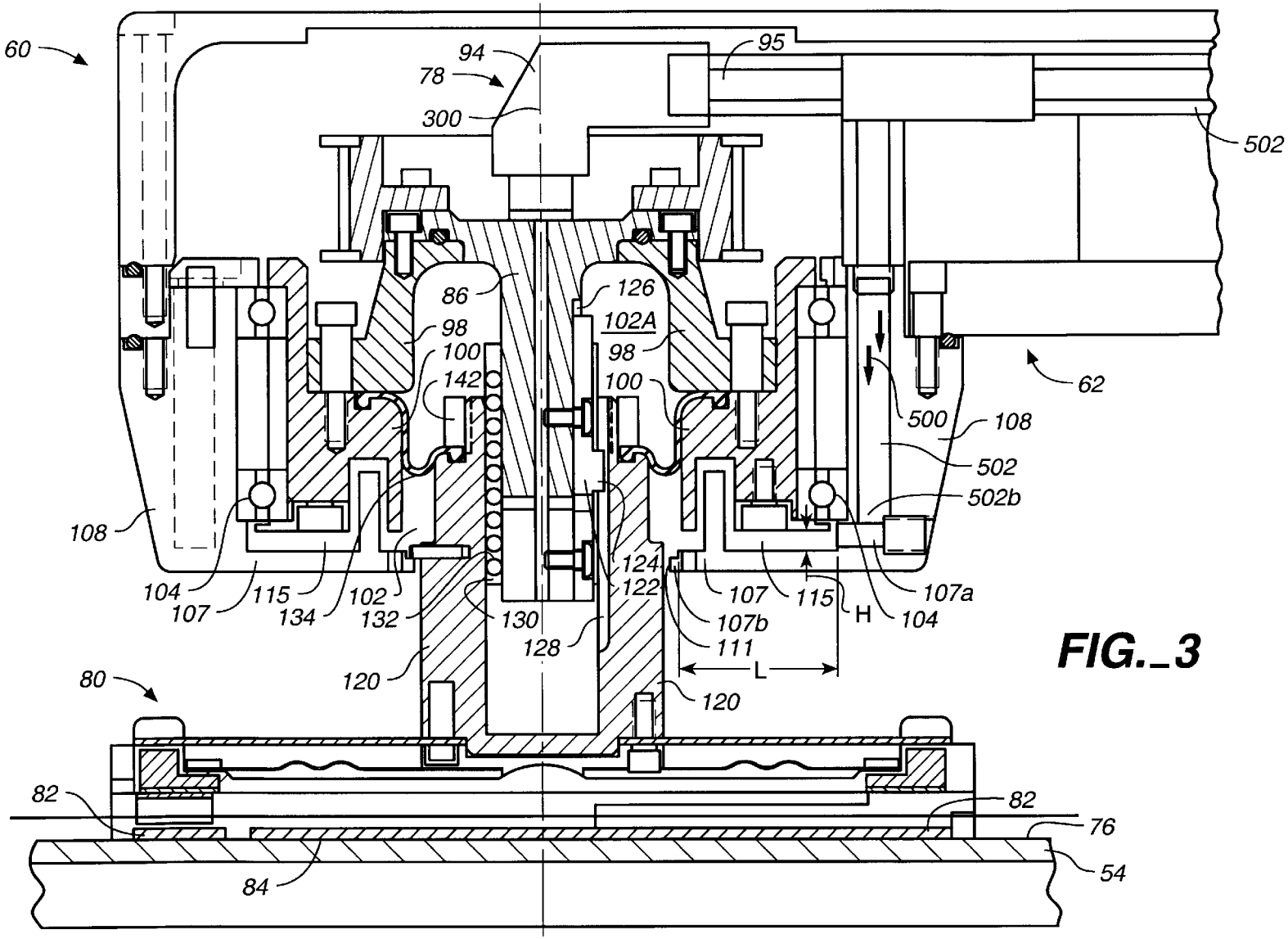
FIG. 3 is a diagrammatic cross-sectional view of a conditioner head with an air purge system.
Figure 4:
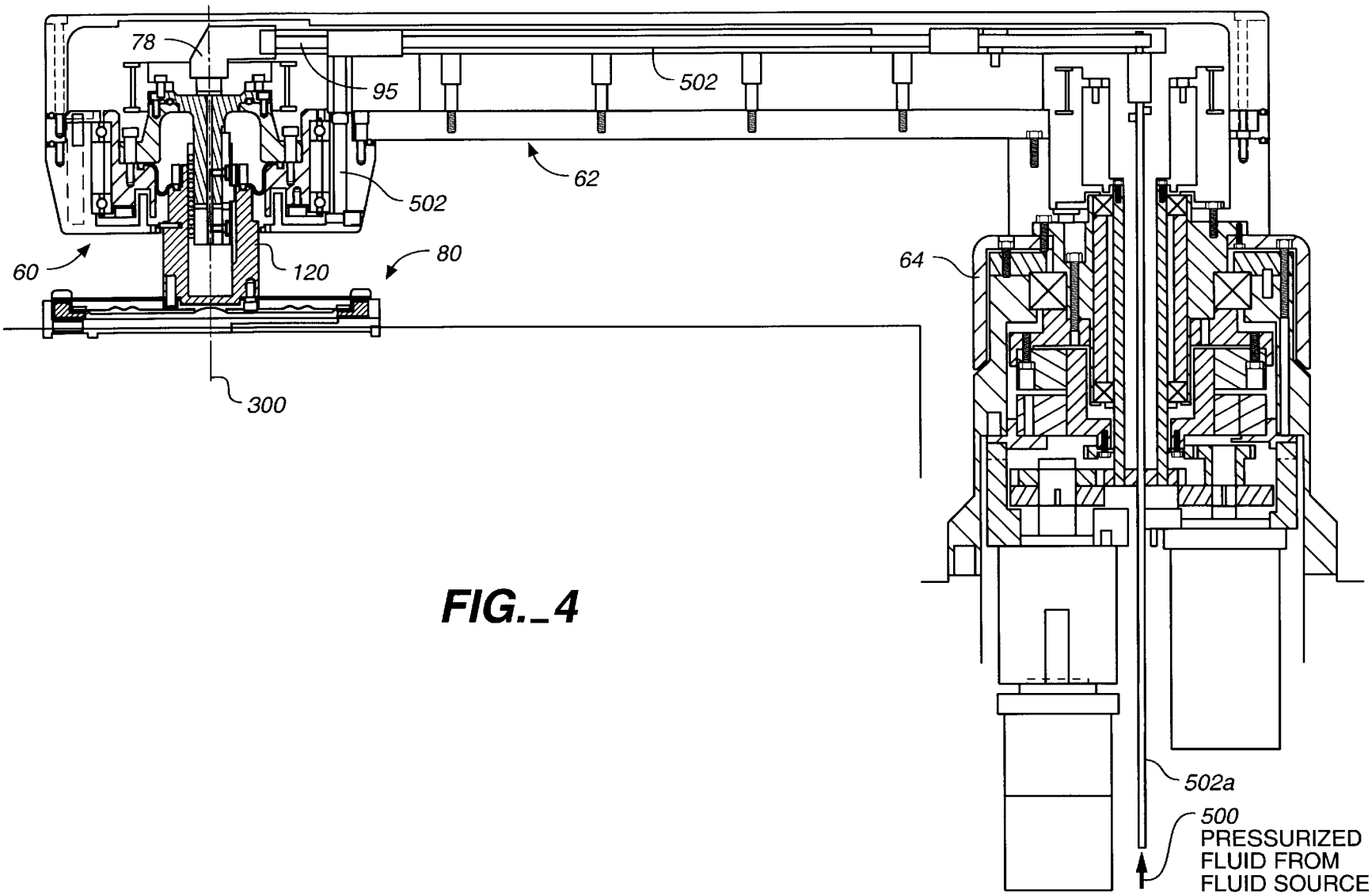
FIG. 4 is a diagrammatic cross-sectional view of a conditioner head and arm with an air purge system.

Referring to FIGS. 3 and 4, a conditioner head 60 includes an actuation and drive mechanism 78 which rotates a disk backing element 80 about a central vertically-oriented longitudinal axis 300 of the head. The disk backing element 80 carries a diamond impregnated conditioning disk 82. The actuation and drive mechanism 78 further provides for the movement of the disk backing element 80 and disk 82 between an elevated retracted position (not shown) and a lowered extended position (FIG. 3). In the extended position, the lower surface 84 of the disk 82 may be brought into engagement with the polishing surface 76 of the pad 54. Additionally, the disk backing element may be introduced to the cup 66 (FIG. 2B) for cleaning the disk.

Referring again to FIGS. 3 and 4, the conditioner head 60 includes a housing 108 attached to the arm 62, a drive shaft 86 rotating about the longitudinal axis 300, and an annular drive sleeve 120 which couples the disk backing element 80 to the drive shaft 86 and transmits torque and rotation. A collar, having upper and lower pieces 98 and 100, respectively, coaxially surrounds the shaft 86, defining a generally annular space 102. The annular space 102 accommodates the drive sleeve 120.

The drive sleeve 120 is keyed to the drive shaft 86 by a keying member 122 having an outwardly projected keying tab 124. This permits relative longitudinal translation between the drive sleeve 120 and the drive shaft 86 while preventing relative rotation. The keying member 122 is secured within a vertical slot 126 in the periphery of shaft 86 and the tab 124 rides within a vertical slot 128 in the interior of sleeve 120 and interacts with the sides of the slot 128 to prevent relative rotation of the shaft and sleeve. To provide a smooth sliding vertical engagement between the drive shaft 86 and drive sleeve 120, a bearing having a cage 130 and a plurality of balls 132 is interposed between the inner cylindrical surface of the sleeve 120 and the outer cylindrical surface of the shaft 86.

A closed chamber 102A is formed in the upper portion of the annular space 102 by sealing the bottom of the annular space 102 with a generally-annular elastomeric diaphragm 134. To move the drive sleeve 120 and the attached disk backing element 80 from the extended position to the retracted position the chamber 102A is deflated. To move the drive sleeve 120 and the attached disk backing element 80 from the retracted position to the extended position the chamber 102A is inflated by pressurized air. Pressurized air is supplied to chamber 102A through line 95. The chamber 102A is deflated also through line 95. Line 95 is connected to a pressurized air source (not shown), which may be a container or an apparatus producing pressurized air. The deflation and inflation of chamber 102A and the amount of downforce applied to the disk backing element 80 are proportional to the air pressure. The air pressure may be regulated by a pressure regulator, venturi or pump connected to line 95 (not shown).

A bearing system 104 supports the lower collar piece 100 in the housing 108 while permitting rotation of the shaft/collar unit around the longitudinal axis 300 within the housing 108. The housing 108 has a shield 107 at the bottom coaxially surrounding the drive assembly 78. The shield prevents the flow of debris during polishing from the polishing head into the bearing system. Between the shield 107 and the lower collar 100 a labyrinth opening 115 is formed. This opening allows the shaft/collar unit to rotate around the longitudinal axis 300 within the housing 108 without touching the shield 107. In one example, the labyrinth opening has a height H of about 0.1 inch, and a length L of about 0.6 inch. The shield 107 has one end 107*a* attached to the housing 108 by a screw and a free end 107*b* extending towards the drive sleeve 120. Between the free end 107*b* and the drive sleeve 120 there is a gap 111.

The conditioning process produces debris, such as coagulated slurry particles and fragments of the polishing pad. The debris may be propelled by the vertical motion of the drive sleeve and the rotational motion of the abrasive disk into the conditioner head. If this occurs, the debris may interfere with the rotational motion of the shaft/collar unit. Although the shield 107 prevents much of the debris from entering the conditioner head, some debris may still enter and become lodged in the labyrinth opening 115. The debris then may cause deterioration of the bearing system 104 and the elastomeric diaphragm 134.

To prevent the accumulation of slurry on the bearing system 104 and to remove debris from the labyrinth opening 115, pressurized fluid 500 is introduced into the labyrinth opening 115 via a fluid line 502. The fluid line 502 has an inlet 502*a*, an outlet 502*b*, and runs through the housing 108, the conditioner arm 62 and the base 64 (FIG. 4). The inlet 500*a* is connected to a source of pressurized fluid (not shown, and the outlet 502*b* terminates into the labyrinth opening 115. The source of pressurized fluid may be a container filled with the fluid or an apparatus producing the fluid. In one example, the fluid may be nitrogen. The nitrogen pressure at the source may be between 10 to 25 psi. The pressure at the source may be selected so that the fluid pressure at the gap 111 inside the conditioner head is slightly higher than atmospheric pressure. To maintain the pressure at the gap 111 above atmospheric, the gap needs to be very narrow. In one example, the gap is approximately 0.02 inch wide.

One embodiment of the present invention has been described. Nevertheless, it will be understood that various modifications may be made without departing from the spirit and scope of the invention. For example, the fluid line 502 may be replaced by a tubing. The tubing may be brought to the bearing system 104 and the labyrinth opening 115 outside of the conditioning arm 62 and the housing 108. Other fluids may include pressurized air, inert gases such as helium or argon or liquids, such as water or reactive solvents for removing the deposits. Various features may be adapted for use with a variety of existing or future conditioner and polisher configurations other than those specifically shown.

Accordingly, other embodiments are within the scope of the following claims.

What is claimed is:

1. A conditioner head for conditioning the polishing surface of a polishing pad, comprising:

an abrasive element engageable with the polishing surface of the polishing pad;

a drive assembly coupled to the abrasive element and transmitting rotation to the abrasive element;

a housing surrounding the drive assembly;

a bearing coupling the drive assembly to the housing and enabling rotation of the drive assembly within the housing; and a fluid purge system directing fluid into the housing past the bearing to prevent particles from reaching the bearing.

2. The conditioner head of claim 1 further comprising a backing element carrying the abrasive element.

3. The conditioner head of claim 1 wherein the abrasive element is an abrasive disk.

4. The conditioner head of claim 1 wherein:

the drive assembly includes a drive element carried for rotation about a longitudinal axis and a rotatable element coupling the abrasive element to the drive element.

5. The conditioner head of claim 4 wherein:

the drive element includes a drive shaft and a collar, the collar being substantially fixed to the drive shaft;

the rotatable element includes a drive sleeve encircling at least a length of the drive shaft; and the bearing couples the collar to the housing for permitting the collar to rotate within the housing.

6. The conditioner head of claim 5 wherein the housing includes a shield attached around a bottom opening in said housing to prevent particles from entering the conditioner head through said bottom opening, and wherein a labyrinth opening is formed between the shield and the collar.

7. The conditioner head of claim 6 wherein the fluid purge system includes:

a source providing a fluid; and a fluid line that carries fluid from the source to the housing past the bearing and into the labyrinth opening.

8. The conditioner head of claim 1 wherein the fluid is a gas selected from the group consisting of nitrogen, argon, helium and air.

9. The conditioner head of claim 1 wherein the fluid is a liquid selected from the group consisting of water and reactive solvents.

10. The conditioner head of claim 1 wherein said housing is coupled to a conditioner arm for moving the head at least transverse to a longitudinal axis.

11. The conditioner head of claim 10 wherein fluid is directed to the bearing and a labyrinth opening in the housing through a fluid line in the conditioner arm and the housing.

12. A conditioner head for conditioning the polishing surface of a polishing pad, comprising:

a drive element carried for rotation about a longitudinal axis; the drive element including a drive shaft and a collar;

a disk backing element for carrying an abrasive disk and holding it in engagement with the polishing pad;

a rotatable element coupling the disk backing element to the drive element, the rotatable element including a drive sleeve surrounding at least a length of the drive shaft;

a housing surrounding the drive element and having a bottom opening;

a bearing coupling the collar to the housing for permitting the collar to rotate relative to the housing;

a fluid source, and a fluid line connected to the fluid source, the fluid line supplying and directing fluid into the housing past the bearing to prevent particles from reaching the bearing.

13. The conditioner head of claim 12 wherein the housing includes a shield attached to said bottom opening preventing particles from entering the conditioner head and wherein a labyrinth opening is formed between the shield and the collar.

14. The conditioner head of claim 13 wherein fluid is supplied to the labyrinth opening.

15. A conditioner head for conditioning the polishing surface of a polishing pad, comprising:

an abrasive element engageable with the polishing surface of the polishing pad;

a drive assembly coupled to the abrasive element and transmitting rotation to the abrasive element;

a housing surrounding the drive assembly; and a fluid purge system directing fluid into the housing to prevent particles from contaminating the drive assembly.

16. A method for conditioning a polishing pad having a polishing surface, comprising:

providing an abrasive conditioning element carried by a carrier head and having a lower surface engageable with the polishing surface of the polishing pad;

rotating the abrasive conditioning element and bringing the lower surface of the conditioning element into engagement with the polishing surface of the polishing pad; and directing a fluid past a bearing system in the carrier head, said bearing system enabling rotation of the conditioning element, and said fluid preventing particles from reaching the bearing system.

* * * * *